US006571399B1

(12) United States Patent
Wagener

(10) Patent No.: US 6,571,399 B1
(45) Date of Patent: Jun. 3, 2003

(54) FEMALE URINAL FIXTURE

(76) Inventor: Reuben O'Neil Wagener, 2 Summer St., Apt. 2-A, Norwalk, CT (US) 06851

( * ) Notice: Subject to any disclaimer, the term of this patent is extended or adjusted under 35 U.S.C. 154(b) by 0 days.

(21) Appl. No.: 10/234,997

(22) Filed: Sep. 4, 2002

(51) Int. Cl.[7] ..... E03D 13/00
(52) U.S. Cl. ..... 4/301; 4/254
(58) Field of Search ..... 4/254, 301, 405, 4/411, 661

(56) References Cited

U.S. PATENT DOCUMENTS

| | | | | | |
|---|---|---|---|---|---|
| 1,243,148 | A | * | 10/1917 | Erwin | 4/254 |
| 3,549,226 | A | * | 12/1970 | Samson | 4/661 |
| 4,012,797 | A | * | 3/1977 | Kristoffersen | 4/254 |
| 4,244,064 | A | * | 1/1981 | Parr | 4/254 |
| D274,288 | S | * | 6/1984 | Shanks | D23/295 |
| 6,370,705 | B1 | * | 4/2002 | Levinson | 4/301 |

* cited by examiner

*Primary Examiner*—Gregory Huson
*Assistant Examiner*—Tuan Nguyen

(57) ABSTRACT

A porcelain or stainless steel urinal bowl that mounts to the wall and has a narrow front extension out from the bowl, which will allow a female user to have convenient access above the bowl. The narrow front part of the bowl will be no more than six inches wide so the user can easily straddle the bowl. The bowl has a fresh water supply, which supplies water through a plurality of holes underneath the upper rim opening of the bowl, and a flush mechanism, which has a series of drain holes that empty the urine and water into the connected sewer drain when flushed by means of a hand or foot lever mounted to the bowl. An optional horizontal hand-rail is provided above the urinal, as is padded metal knee support pads that extend from each side of the urinal and are supported by rods extending down to the floor, thereby providing additional body support to help prevent slipping or falling while using the urinal. Toilet paper is provided nearby and can be disposed of by maceration means. Optionally, a reservoir can be built into the urinal bowl and a larger flush drain opening provided for conveniently disposing of toilet paper directly from the bowl.

8 Claims, 4 Drawing Sheets

FEMALE URINAL FIXTURE

BACKGROUND OF THE INVENTION

1. Field of the Invention

The present invention relates to urinals in general and primarily those for use by females. The female urinal fixture has particular utility in speeding up the process and shortening the lines to women's restrooms at high-attendance events.

2. Description of the Prior Art

Anyone attending a major sporting event or concert has observed the relatively long lines outside the women's restrooms as compared to men's restrooms. This has partly be attributed to the fact that the urinals in the men's restroom require less space than do the commodes in the women's restroom, thereby providing more stations and a higher throughput for the men.

The use of female urinals is known in the prior art. For example, U.S. Pat. No. 4,985,940 to Jones discloses a urinal for use by female individuals. However, the Jones '940 patent does not provide a free-standing structural fixture, but has the drawback of requiring that the individual use a flexible hose and funnel coupled into a urinal.

U.S. Pat. No. 4,683,598 to Jones discloses a urinal for use by females that also requires the use of a flexible hose connected to the urinal. However, the Jones '598 patent does not disclose a free-standing structural fixture that is used directly, but has the further drawback of requiring the use of a flexible hose with a flared funnel-like end.

U.S. Pat. No. 5,224,222 to Jones discloses urinals that again use a hose and funnel configuration. However, the Jones '222 patent is different in structure from the present invention in that it requires the use of a flexible hose and funnel arrangement, and cannot be used as a stand-alone urinal as in the case of men's urinals.

Similarly, U.S. Pat. No. 3,964,110 to Kapit discloses a portable unisex urinal that may be considered relevant to the disclosed structural aspects of the present invention. However, there are significant structural differences between the presently disclosed invention and the Kapit '110 patent, which has emphasis on portability.

Lastly, U.S. Pat. No. 6,202,225 to Beck et al. and U.S. Pat. No. Des D201,120 to Robare relate to urinals in general and may be of general interest and pertinent to the construction and design of the present invention.

However, the above-mentioned patents to Jones '940, Jones '598, Jones '222, and Kapit '110 have structural differences, whether reviewed individually or in combination, from the present invention.

While the above-described devices fulfill their respective, particular objectives and requirements, the aforementioned patents do not describe a free-standing urinal for use by females that allows the convenience of those used by males. The Jones '940, Jones '598, and Jones '222 patents make no provision for a free-standing urinal, but all require the use of a flexible hose and funnel configuration, and the Kapit '110 patent describes a portable urinal.

Therefore, a need exists for a new and improved female urinal that can be walked up to and used without the need of ancillary apparatus. In this regard, the present invention substantially fulfills this need. In this respect, the female urinal fixture according to the present invention substantially departs from the conventional concepts and designs of the prior art, and in doing so provides an apparatus primarily developed for the purpose of speeding up the time required for women to visit the restroom at high-attendance public events.

SUMMARY OF THE INVENTION

In view of the foregoing disadvantages inherent in the known types of urinals for females now present in the prior art, the present invention provides an improved female urinal fixture, and overcomes the above-mentioned disadvantages and drawbacks of the prior art. As such, the general purpose of the present invention, which will be described subsequently in greater detail, is to provide a new and improved female urinal fixture, which has all the advantages of the prior art mentioned heretofore and many novel features that result in a female urinal fixture, that is not anticipated, rendered obvious, suggested, or even implied by the prior art, either alone or in any combination thereof.

To attain this, the preferred embodiment of the present invention essentially comprises a porcelain or stainless steel urinal bowl that mounts to the wall and has a narrow front extension outward from the bowl, which allows a female user to have convenient access above the bowl. The narrow front part of the bowl will be no more than six inches wide so the user can easily straddle the bowl. The bowl has a fresh water supply, which supplies water through a plurality of holes underneath the upper rim opening of the bowl, and has a series of drain holes which empties the urine and water into the connected sewer drain when flushed by means of a hand or foot lever-operated mechanism mounted to the bowl. An optional horizontal hand-rail is provided above the urinal, as are padded metal knee supports that extend from each side of the urinal and supported by supports rods extending down to the floor, thereby providing additional body support to help prevent slipping or falling while using the urinal. Toilet paper is provided nearby and can be disposed of by maceration or other paper disposal means.

A second embodiment of the present invention has a water reservoir built into the urinal bowl and a larger drain opening for conveniently flushing of toilet paper from the bowl directly into the drain.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new female urinal fixture that provides in the apparatuses and methods of the prior art some of the advantages thereof, while simultaneously overcoming some of the disadvantages normally associated therewith.

It is another object of the present invention to provide a new and improved female urinal fixture that may be easily and efficiently manufactured and marketed.

An even further object of the present invention is to provide a new and improved female urinal fixture that has a low cost of manufacture with regard to both materials and labor, and which accordingly is then susceptible of low prices of sale to commercial plumbing suppliers and the consuming public, thereby making such urinal fixtures economically available to the buying public.

Lastly, it is an object of the present invention to provide a new and improved female urinal fixture that will help alleviate the long lines outside women's restrooms at public events. Although, the use of the urinal will require about the same amount of time as the use of a standard commode, the space required will be less since the stalls can be somewhat smaller, and therefore the number of stations can be increased.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
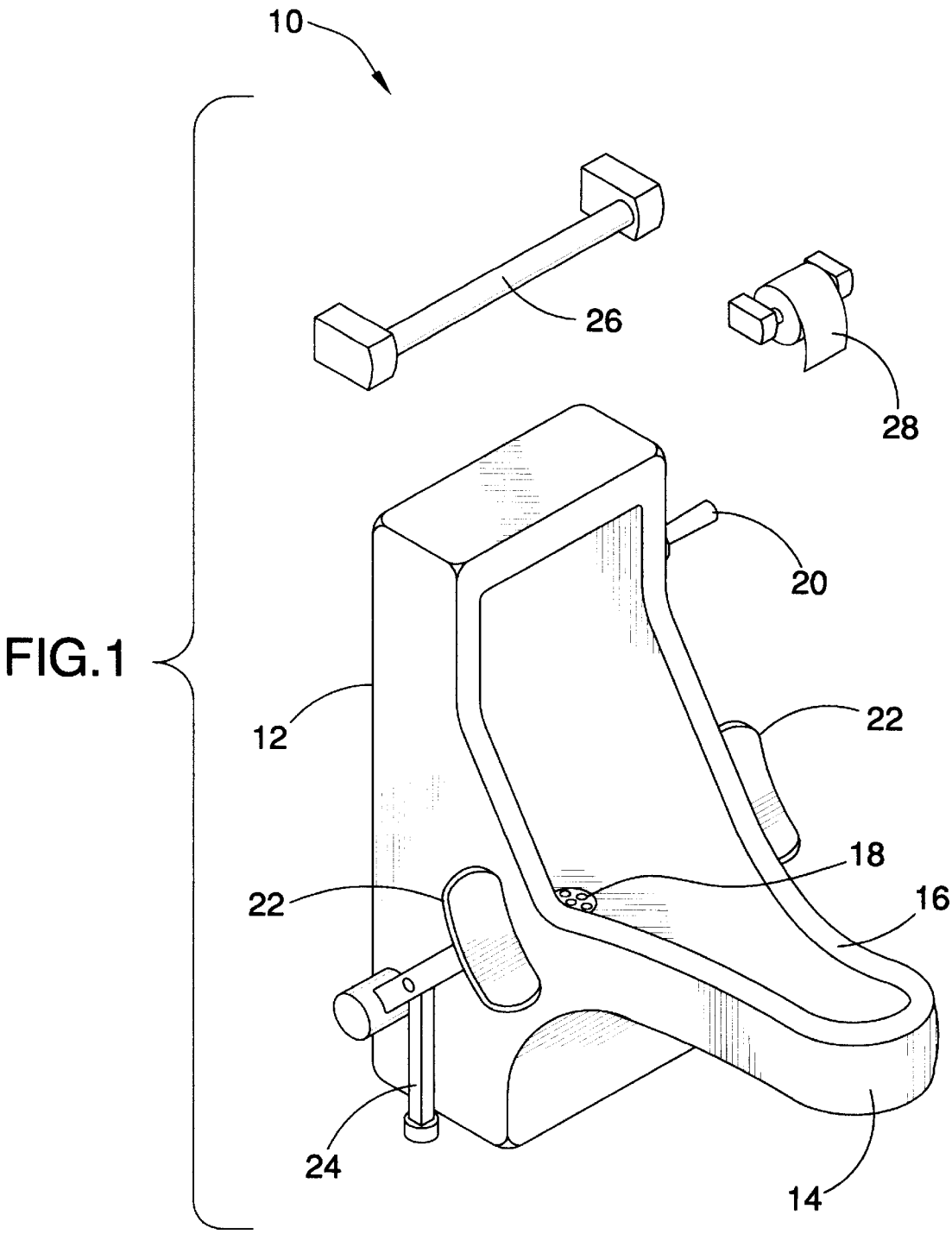
FIG. 1 is a perspective view of the preferred embodiment of the female urinal fixture constructed in accordance with the principles of the present invention.

Referring now to the drawings, and particularly to FIGS. 1–4, a preferred embodiment of the female urinal fixture of the present invention is shown and generally designated by the reference numeral 10.

Figure 2:
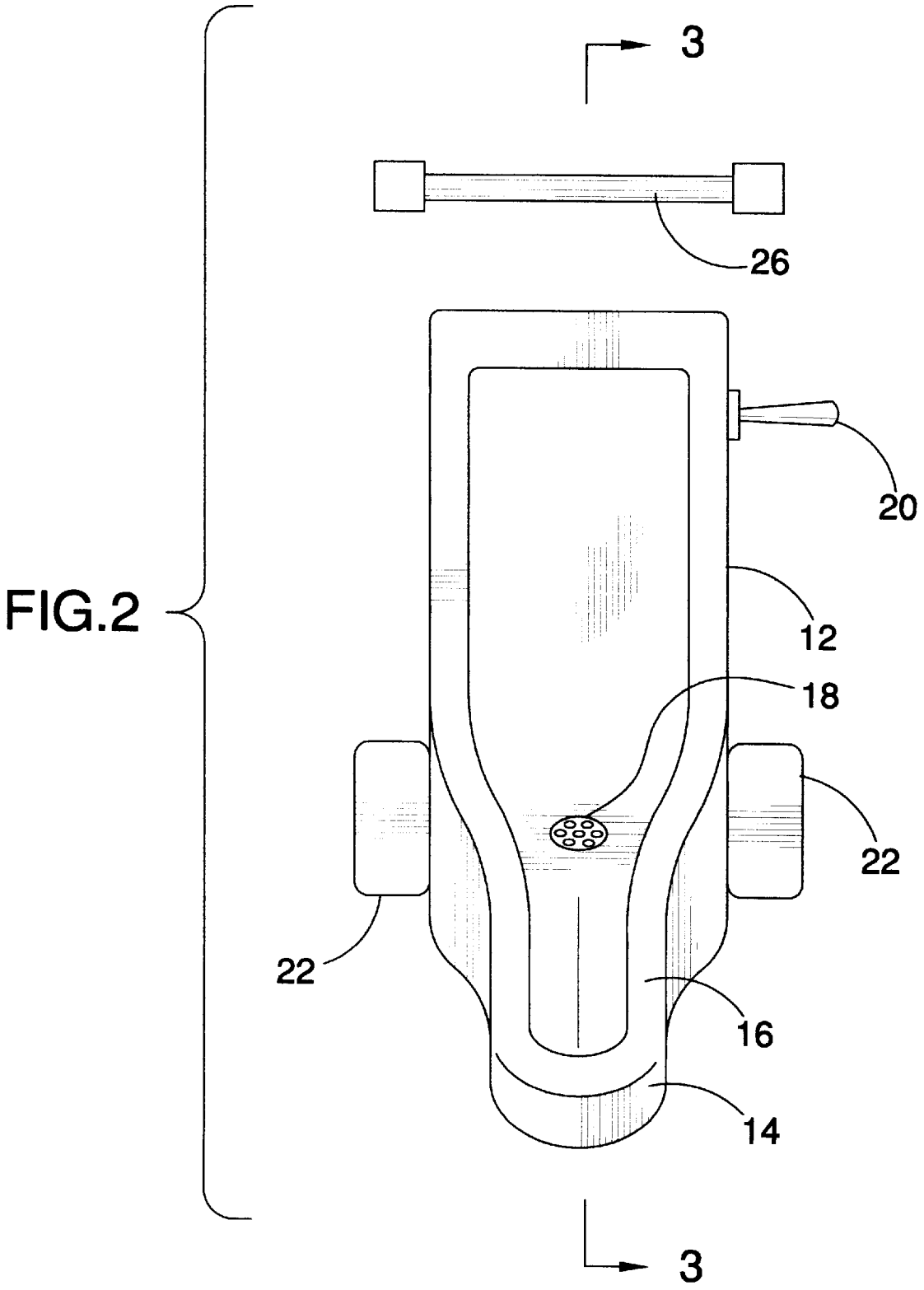
FIG. 2 is a front view of the female urinal fixture of the present invention.
Figure 4:
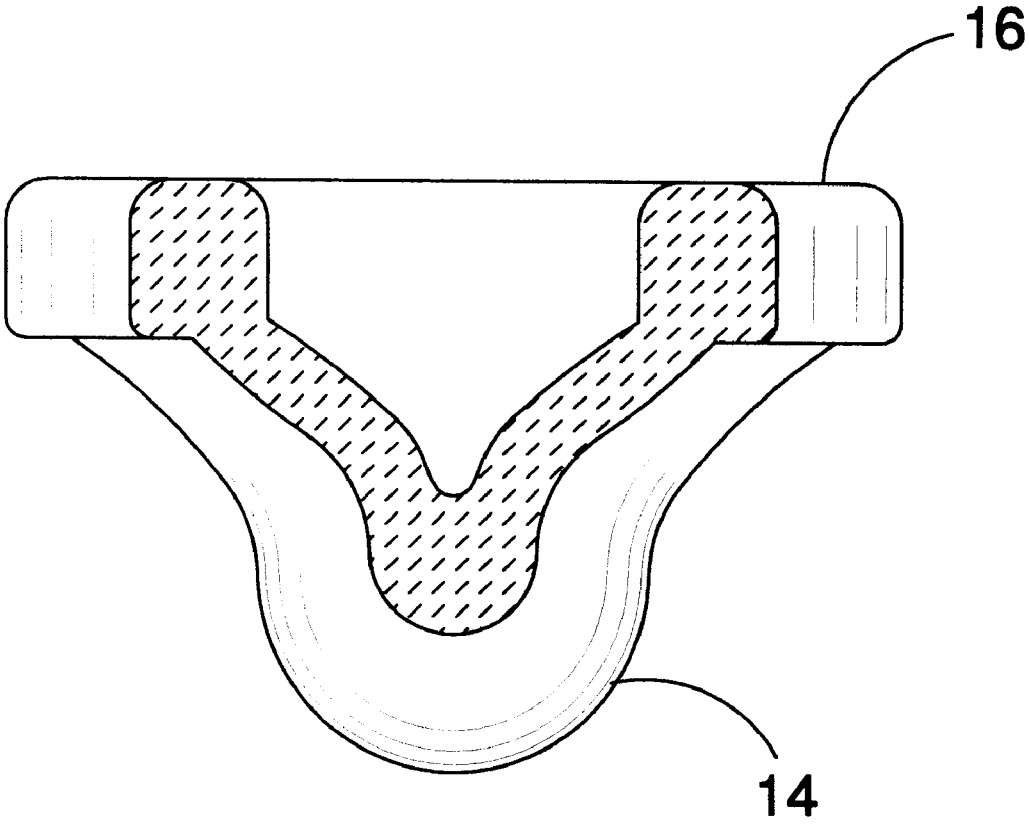
FIG. 4 is a cross-sectional front view of the female urinal fixture of the present invention.

In FIGS. 1, 2, and 4 a perspective view, front view, and cross-sectional front view, respectively, for the new and improved female urinal fixture 10 of the present invention, is illustrated and will be described. More particularly, the female urinal fixture 10 has a urinal bowl 12 that mounts on to a vertical wall and has a long, narrow extension 14 outwardly from the front to allow easy access over the bowl. The front access bowl extension 14 is no more than 6-inches in width, thereby allowing the uses to easily straddle the bowl. The bowl 12 has a fresh water supply, which supplies water through a plurality of small holes underneath the upper rim 16 opening of the bowl, and has a series of drain holes 18 that empties the urine and water into the connected sewer drain when flushed by means of a hand or foot lever 20 operated mechanism mounted to the bowl. An optional horizontal hand-rail 26 is provided above the urinal, as are padded metal knee supports 22 that extend from each side of the urinal and supported by supports rods 24 extending down to the floor, thereby providing additional body support to help prevent slipping or falling while using the urinal. An anti-splatter pad can be installed in the bottom of the urinal to help prevent the splashing of urine and water on to the user. Optionally, toilet paper is provided on a nearby hanger 28, with the paper being disposed of by waste can or by use of an electric or water driven macerator (not shown).

In a second embodiment of the present invention, a water reservoir is built into the urinal bowl 12 and a larger drain opening is provided for conveniently disposing of toilet paper directly from the bowl into the drain.

Figure 3:
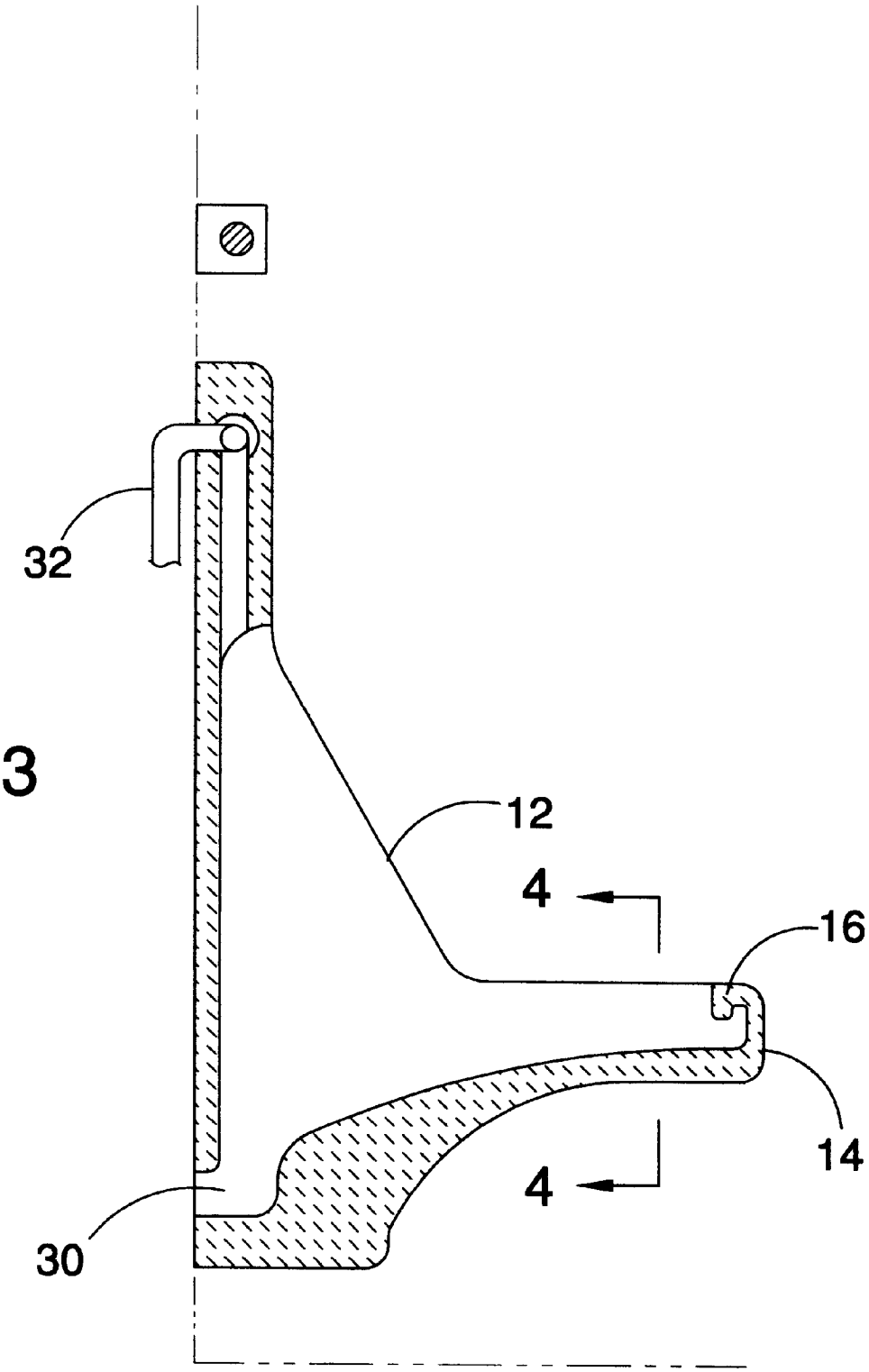
FIG. 3 is a cross-sectional side view of the female urinal fixture of the present invention.

FIG. 3 is a cross-sectional side view of the female urinal fixture of the present invention, which shows the side profile of the urinal and further points out the outgoing sewer drain 30 and the incoming fresh water supply line 32.

FIG. 4 further shows the front profile of the urinal.

In use, a female user can enter a somewhat smaller (than usual) stall and approach facing the urinal, standing over and straddling the narrow front extension 14 of the device while urinating. For more stability, the user can hold on to the horizontal hand bar 26 and if necessary bent the knees slightly to fit into the knee support pads 22 to lower the body closer to the urinal 14. The available toilet paper 28 can then be used to cleanup with the paper being disposed of in a nearby trashcan or macerator. In the second embodiment of the invention, toilet paper can be dropped into a water reservoir built into the urinal and flushed down the drain. Finally, the flush lever 20 is used to flush and wash down the entire urinal.

The appealing benefits of the female urinal fixture of the present include its ease of use, efficiency, and convenience, which will permit more women to more quickly use a public restroom than would otherwise be possible. Its strategically placed handrail and kneepads will eliminate the need for women to attempt to use the urinal in an awkward, self-supported, squatting position. It could also potentially reduce the amount of overall water consumption in public restrooms.

While a preferred embodiment of the female urinal fixture has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable material typically used in plumbing fixtures may be used to manufacture the fixture. Also, besides providing a water reservoir to the urinal and adding a larger drain for disposing of toilet paper, any conventional paper disposal method can be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A urinal fixture for use by females, comprising:

a urinal bowl, said bowl having a narrow portion extending outward at the front of said bowl for convenient access by the user in straddle position, a plurality of flush holes being located in the bottom of said bowl, said bowl having an upper rim with a plurality of perforated holes for supplying fresh water, said bowl having a drain opening, said bowl further having flushing means for suitable flushing of urine and water through said drain opening of said bowl;

a fresh water source coupled to said bowl;

a sewer drain coupled to said drain opening;

a flush lever mounted to the top portion of said bowl for activating said bowl's flushing means; and first and second knee support pads extending from the left and right side of said bowl, respectively, for frictionally supporting the weight of the user in knelling position so as to allow the user body be lowered closer to the urinal, said knee support pads having support rods coupled to the floor, and said knee pads being further adjustable in height by adjustable means.

2. The fixture of claim 1, wherein said narrow portion of said bowl extends outward approximately 2 feet from said bowl for convenience in standing over said bowl.

3. The fixture of claim 2, wherein said narrow portion of said bowl is no more than 6 inches in width for convenience in straddling said bowl.

4. The fixture of claim 1, wherein said bowl is constructed from materials from the group comprised of: porcelain, vitreous china, and stainless steel.

5. A urinal system for use by females, comprising:

an urinal bowl mounted to a vertical wall, said bowl having a narrow portion extending outward from said wall to the front of said bowl for convenient access by the user in straddle position, said bowl having a plurality of flush holes in the bottom, said bowl having an upper rim with a plurality of perforated holes for supplying fresh water, said bowl having a drain opening, said bowl further having flushing means for suitable flushing of urine and water through said drain opening of said bowl;

a fresh water source coupled to said bowl;

a sewer drain coupled to said drain opening;

a flush lever mounted to the top portion of said bowl for activating said bowl's flushing means;

first and second knee support pads extending from the left and right side of said bowl, respectively, for frictionally supporting the weight of the user in kneeling position so as to allow the user body be lowered closer to the urinal, said knee support pads having support rods coupled to the floor, and said kneepads being further adjustable in height by adjustable means;

a horizontal handrail mounted to said wall above said bowl at arms reach to provide additional user support;

a toilet paper roll mounted to said wall at arms reach by hanger means, for user clean-up purposes.

6. The system of claim 5, wherein said narrow portion of said bowl extend outward approximately 2 feet from said wall for convenience in standing over said bowl.

7. The system of claim 6, wherein said narrow portion of said bowl is no more than 6 in width inches for convenience in straddling said bowl.

8. The system of claim 5, wherein said bowl is constructed from materials from the group comprised of: porcelain, vitreous china, and stainless steel.

* * * * *